United States Patent [19]

Mertin et al.

[11] 4,422,280

[45] Dec. 27, 1983

[54] INSULATING GLASS UNIT

[75] Inventors: Dietrich Mertin, Witten; Paul Derner; Wolf von Reis, both of Gelsenkirchen, all of Fed. Rep. of Germany

[73] Assignee: BFG Glassgroup, Paris, France

[21] Appl. No.: 255,994

[22] Filed: Apr. 21, 1981

[51] Int. Cl.[2] ..... E04C 2/54

[52] U.S. Cl. ..... 52/788

[58] Field of Search ..... 52/788, 172, 202, 307, 52/308

[56] References Cited

U.S. PATENT DOCUMENTS

| | | | |
|---|---|---|---|
| 2,226,254 | 12/1940 | Owen | 52/202 |
| 2,308,918 | 1/1943 | Hertel et al. | 52/788 |
| 2,587,063 | 2/1952 | Petsch | 428/34 |
| 4,047,351 | 9/1977 | Derner et al. | 52/172 |

*Primary Examiner*—James L. Ridgill, Jr.

*Attorney, Agent, or Firm*—Karl F. Ross; Herbert Dubno

[57] ABSTRACT

An insulating window structure with improved sound-damping properties comprises an inner window pane, an outer window pane, a spacing frame holding the two panes apart so that they define a gas space between them, and a membrane-like yieldable member connecting at least one of these panes to the frame. The membrane-like member is in the form of a strip whose bending strength or stiffness is small by comparison with that of the pane to which it is bonded at least over the edge regions of the latter pane and the strip at which the bonding is effected. The strip is dimensioned and composed of a material such that transverse undulations developed at the edges of the pane are not resisted, i.e. the undulations along the edges of the pane are followed by the strip without significant resistance.

10 Claims, 4 Drawing Figures

INSULATING GLASS UNIT

FIELD OF THE INVENTION

Our present invention relates to an insulating glass unit and, more particularly, to an insulating window structure of the double-pane type with improved acoustic damping properties.

BACKGROUND OF THE INVENTION

Insulating windows and window-pane units generally comprise an inner glass pane, an outer glass pane and a frame in which the panes are sealingly received and serving to space these panes apart so that the panes define a gas-filled space between them.

One or both of the panes may be formed by a single glass sheet or a plurality of glass sheets with evacuated or gas-filled spaces and the entire assembly may be sealed along its periphery and received in a sash or other assembly for insertion into a window opening or can be built directly into the window opening.

It is known (see German patent document No. 20 31 576, FIG. 2) to provide a yieldable membrane between at least one of these panes and the remainder of the frame. This membrane is resilient, i.e. resists displacement by the development of a spring or restoring force and may be provided in the form of a spring metal strip with harmonica-like folds allowing relative displacement of the panes.

The spring strip serves to secure the pane to which it is connected in the structure in a manner enabling thermal variation of the volume of the space between the panes by deformation of the spring strip in a uniform piston-like manner. The spring strip tends to bulge outwardly when the space is filled with gas under pressure and the pane is pressed outwardly by the pressure differential thereacross. The spring strip thus tends to limit or avoid bulging of the glass or any deformation thereof.

While such window units have been found to have some insulating capacity, they do not have a significant acoustic damping effect, i.e. they do not attenuate sound transmission through the window structure to a sufficiently high degree. For instance, when the width of the spacing between the inner and outer panes is about 10 mm, a common dimension, the sound transmission attenuation is in the range of 20 to 30 decibels (dB).

It is possible, with structural complications, to increase the spacing between the inner and outer panes to a value of, say, 100 mm and thereby to increase the mean attenuation of sound transmission through the window structure, i.e. the sound damping to about 38 to 40 dB.

It is difficult, if not impossible, with conventional thicknesses, reasonable spacings of the two glass panes and an overall thickness of the structure of 70 to 80 mm to achieve an acoustic damping in excess of 42 dB.

OBJECTS OF THE INVENTION

It is the principal object of the present invention to provide an improved window unit whereby the disadvantages of earlier insulating window structures can be avoided and a high degree of acoustic damping achieved.

Another object of the invention is to provide an insulating window structure with a high degree of acoustic damping, simple and inexpensive construction, and a reasonable overall thickness of the structure.

SUMMARY OF THE INVENTION

These objects and others which will become apparent hereinafter are attained, in accordance with the present invention, in an insulating window structure comprising an inner glass pane, an outer glass pane and a frame connecting the two panes together while spacing the panes apart to define a gas-filled space between them, at least one of the panes being connected in the structure by a membrane strip bonded to the respective pane along an edge zone thereof along one of the faces of the latter pane. Advantageously, this membrane strip is connected to the frame at a location spaced from the zone in which it is connected to the glass pane, i.e. so that between the two connecting regions, the membrane strip is free, unencumbered, nonelastic and capable of unimpeded deformation.

According to the invention, moreover, over the aforementioned zone the flexural stiffness or bending resistance of the membrane strip is significantly less than that of the glass pane in the zone so that transverse edge oscillations, undulations or deformations of the glass pane correspondingly deform the strip in this zone, i.e. the strip can follow such edge transverse deformations without resisting or impeding them.

Transverse edge oscillations or undulations are the undulations which are established along the longitudinal edges of the glass pane and are more or less sinusoidal in nature with crests and troughs extending transverse to the plane of the pane, i.e. the crests of the undulations project out of the normal lay of the pane.

Surprisingly, the use of membrane strips which permit such deformation of the pane but nevertheless yieldably retain the pane of the frame, allow the pane itself to participate significantly in the acoustic damping properties of the structure and results in a significant increase in the sound damping quality of the structure.

According to a feature of the invention, the membrane strip which can be composed of metal, rubber or a synthetic resin (plastic) material or foil, has a flexural stiffness or bending resistance which is smaller by a factor of $10^{-2}$ to $10^{-6}$ than the flexural stiffness or bending resistance of the glass pane in the edge zone thereof at which the strip is bonded. Preferably the factor is $10^{-4}$ to $10^{-5}$. This means that the aforedescribed oscillations or vibrations which develop in the edge zones of the glass pane are practically not damped by the strip itself which exerts neither compression nor tension forces on the glass which could resist the formation of undulations therein.

Advantageously the strip is a planar strip which is bonded to a zone of the respective glass pane which has a width equal to or less than the thickness of the glass pane while a free zone of the strip, between its connection to the frame to its bonding zone is provided of a width which is approximately equal to the thickness of the glass pane or is greater than the latter.

While it is sufficient for most purposes to mount only one of the panes in the window structure by a membrane strip as described, it is possible to mount both panes in this manner although, as noted, sufficient acoustic damping is provided when only a single pane is connected in the structure via the membrane strip. Naturally additional panes can be provided in the assembly as well in which case all of the panes can be yieldably mounted in the manner described to provide a multiple means pane structure where only some of the panes are yieldably mounted.

The term "membrane" is used herein in the sense in which it is used in connection with static structures, i.e. to describe a strip which, while holding the yieldable pane in the structure and contributing to the sealing of the space between the panes, does not interfere with stresses in the yieldable pane or forces in the structure which are transverse to the membrane so that these stresses and the resulting deformations of the pane can be uniformly distributed over the thickness of the membrane. As a result, any displacement of the membrane is not accompanied by a significant restoring force as in the case of a spring element and the pane can act as a sound-damping member without a piston-like contribution to sound transmission.

The theory involved, although not heretofore applied in the manner of the present invention to window structures or the like, will be more readily apparent from *Raum- und Bauakustik, Larmabwehr,* 1972, pages 197 to 230, by Furrer and Lauber, especially page 208 containing FIG. 159 and page 212 containing FIG. 164.

Another advantage of the unit of the present invention is that any resonance condition resulting from the coincidence of the applied acoustic frequency with the resonance frequency of the transverse oscillating mode of the pane cannot be transmitted by the membrane to the frame structure.

In earlier systems, the resonance frequency, once established, could be shifted by the design of the frame as a damping element. Thus while the system of the present invention prevents transmission of the vibrations of the pane to the frame and eliminates the problem of coincidence of the resonance frequency with the incident acoustic frequency, the prior-art systems were at best only capable of reducing the amplitude at resonance.

The result is a qualitative leap in the acoustic damping effect with the system of the present invention such that the transmission of acoustic energy through the window unit of the invention can be reduced by 50% and more. The acoustic damping effect is especially pronounced at frequencies in the center of the audible range, as is especially advantageous. The total glass thickness can be 15 mm or more and the spacing between 10 and 70 mm, preferably between 25 and 50 mm. The glass thickness can be 10 to 35 mm and the spacing increased as the glass thickness is decreased.

For example, with a total glass thickness of 10 mm, the spacing can be equal to or greater than 50 mm, with a total glass thickness of 15 mm, the spacing can be equal to or greater than 25 mm and for a total glass thickness of 20 mm the spacing can be greater than or equal to 10 mm.

It has been found to be advantageous for especially high acoustic damping to fill the space between the panes with a gas in which the speed of sound is at least 10% less than the speed of sound in air. Effective acoustic damping is also obtained when the gas is selected so that the speed of sound is at least 20% and preferably 30% greater than that in air.

It has been found to be advantageous, when especially large insulating glass units are provided, to utilize blocking elements below the edge of the pane to which the membrane strips are attached. Of course, these blocking elements should have a spacing from the pane which is greater than the wavelength of the transverse oscillations at a track or groove-determining frequency. The latter frequency, which can also be considered a track or groove determining frequency, is associated with the phenomenon of wave coincidence. When, with increasing excitation frequency, the wavelength in air is less than the bending wavelength of the glass pane at a predetermined frequency, coincidence effects result. This gives rise to a kind of spatial resonance between the acoustic excitation of the glass pane and its free bending oscillations. This effect, referred to as the trace or track matching or determining effect, results in the groove or track matching frequency. Obviously, since the pane cannot be allowed to abut on any rigid member formed by the support blocks, the spacing between the pane and the member must be greater than the wavelength or amplitude determined by this frequency or at this frequency.

It is also possible, in accordance with the present invention, to provide the membrane strips and/or the panes with additional damping elements. For example, when the membrane strips are applied to the inner surface of a pane, a seaing lip of elastomeric material can rest upon the pane on the opposite side thereof and can be connected with a frame element.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
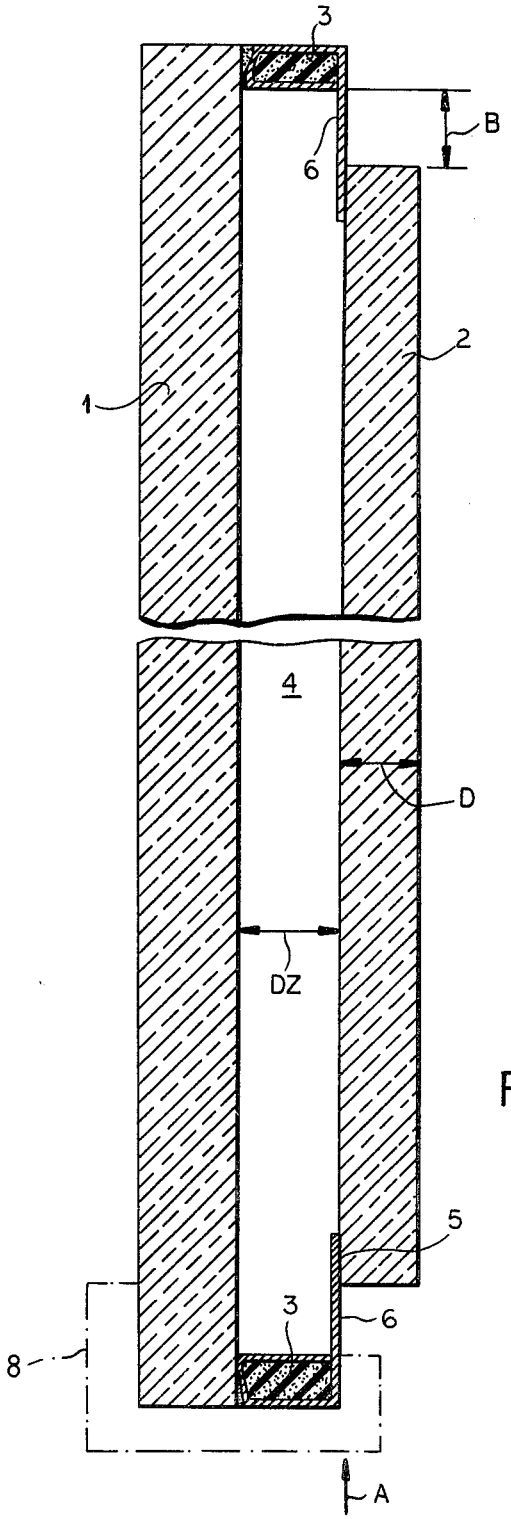
FIG. 1 is a section through a window unit of the present invention.

The drawing shows an insulating glass unit having an inner pane 1, 101, and an outer pane 2, 102, a frame 3, 103, extending around the unit, and a gas-filled space 4, 104, between the panes.

The outer pane 2, 102, over a peripheral zone 5, 105, along the inner broad surface of the frame, is bonded by an adhesive to a bridging member 6, 106, which connects this pane to the profiled frame.

The bridging strip is constituted as a membrane of exaggerated thickness in the drawing and has a bending resistance or flexure stiffness which is small by comparison with that of the pane 2, 102, in the regions in which the pane and the strips are in contact.

The ratio of the bending resistance or flexure stiffness is $10^{-2}$ to $10^{-6}$ as previously described, preferably $10^{-4}$ to $10^{-5}$.

The ratio V is given by the relationship $$V = \frac{E_M \cdot D_{M3}}{E_G \cdot D_{G3}}$$

Figure 2:
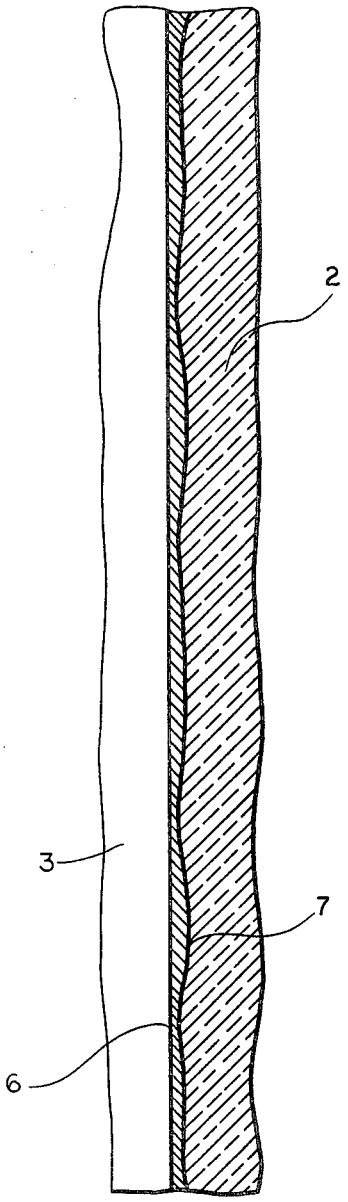
FIG. 2 is a view of the unit in the direction of the arrow A of FIG. 1.

In this formula $E_M$ is the modulus of elasticity of the membrane, $E_G$ is elasticity of the glass pane, $D_M$ is the thickness of the membrane and $D_G$ is the thickness of the glass pane. As can be seen from FIG. 2, when the pane 2 undergoes transverse vibration, the resulting undulations 7 are transmitted to the membrane strip 6 which is correspondingly deformed without creating a resistance to the deformation of the pane.

The membrane strip 6, 106, can be constituted of metal, rubber or plastic.

Advantageously, the strips 6, 106 are planar and have free width B substantially equal to or greater than the thickness of the pane 2, 102.

The thickness DZ of the space can correspond to 10 to 70 mm, preferably about 50 mm while the total thickness of the panes 1, 2 and 101, 102 is 14 mm.

The gas filling the space 4 can consist of a mixture of 40% $SF_6$ and 60% air (by volume) or of helium. In the first case, the gas has a speed of sound which is at least 10% less than that in air while in the second case the gas has a speed of sound which is 20% or more greater than that in air.

A comparison of the insulating glass unit with an otherwise identical structure but wherein the membrane strips are replaced with a resilient bridging member can result in an acoustic damping of about 50 dB with the gases named. This amounts to a 5 dB increase in the acoustic damping, corresponding to a reduction in transmitted sound energy by a factor of 3.2. A minimum of 5 dB damping is added with either of these gases replace air in the system of the invention wherein membrane strips form the bridging members. However, while an increase in the total glass thickness with the system of the invention can increase the acoustic damping still further, with the resilient bridging member of the prior art system, the acoustic damping does not increase with increase in total glass thickness.

Figure 3:
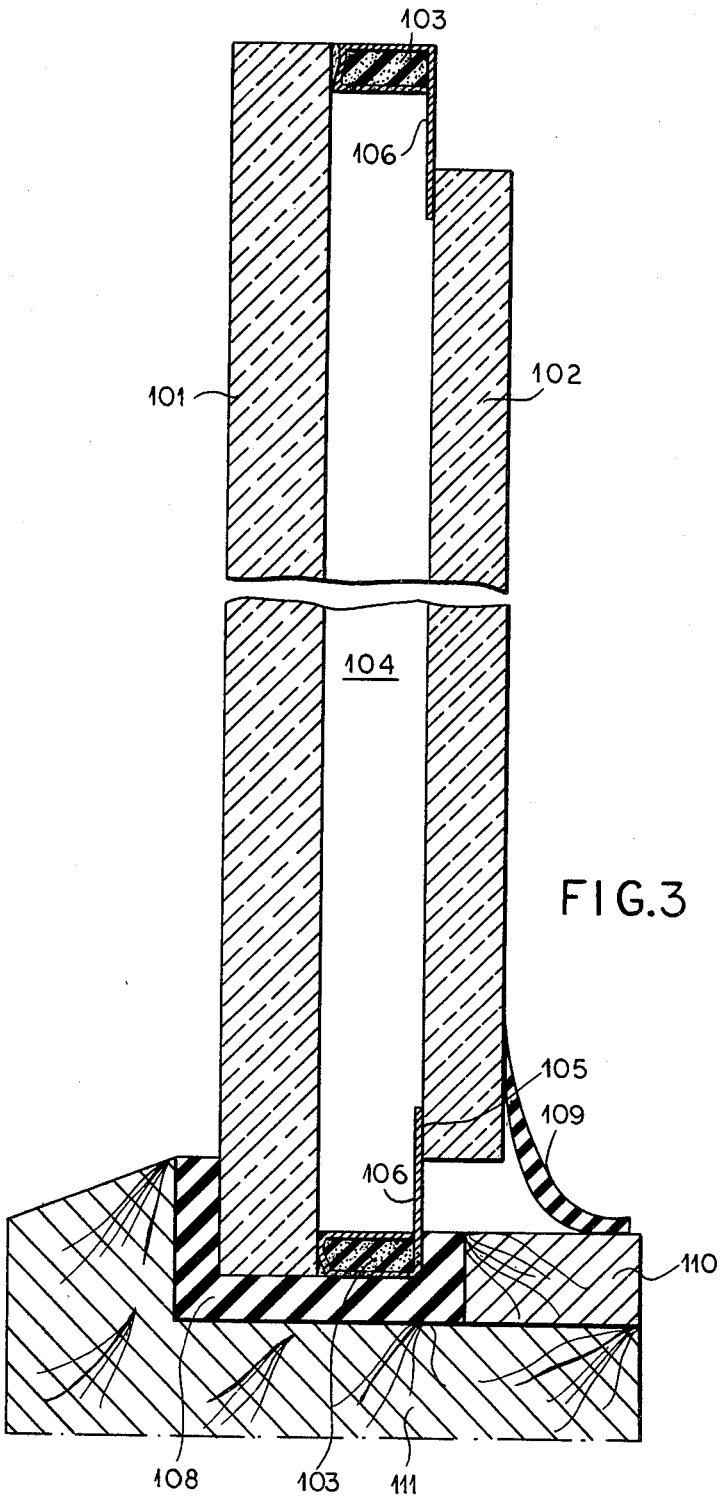
FIG. 3 is a section similar to FIG. 1 illustrating another embodiment of the present invention.

As can be seen in dot-dash lines in FIG. 1 at 8 and in solid line at 108 in FIG. 3, additional damping means, e.g. a polyurethane compound can be provided around the edge of the pane, being spaced, of course, from the pane 2 or 102. Such additional damping means can act upon the membrane strip and/or the pane.

On the side opposite the pane 102, a cover lip 109 of an elastomeric material can be provided, this lip being nailed to a frame member 110 of the wooden frame 111.

SPECIFIC EXAMPLES

The acoustic damping was measured by the two-room method of German Industrial Standard DIN 52 210 and, unless otherwise indicated, the units had panes of glass which were rectangular and generally of 1.25×1.50 m.

Also unless otherwise indicated, the bridging profile or membrane was a steel strip having a width of 30 mm and a thickness of 0.15 mm, the width of the zone along which the strip is bonded to the glass pane being 7 mm while the width of the strip affixed to the frame against free mobility being 10 mm, thereby leaving a free width of 13 mm.

Figure 4:
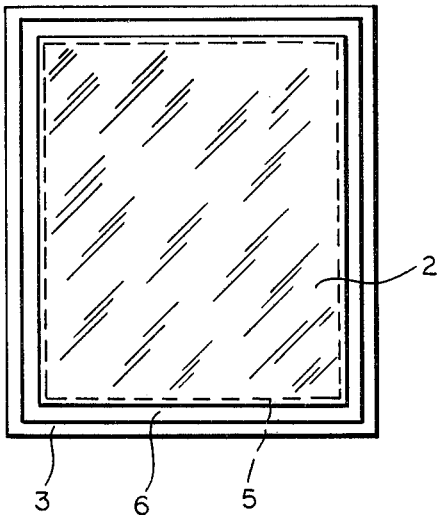
FIG. 4 is an elevational view of the window drawn to a substantially smaller scale than that of FIG. 1.

As can be seen from FIG. 4, the membrane extended on all four sides of the window unit. In the units for comparative purposes in which no membrane was used and no bridging member was employed, both panes were bonded directly to the spacer profile. The latter construction with a membrane is referred to as flexible and the following parameters apply: $D_1$=thickness of the outer pane, $D_2$=thickness of inner pane; DZ=thickness of the gas-filled space between the pane; $R_w$=sound damping.

EXAMPLE 1

$D_1$=5 mm;
DZ=50 mm, filled with 70% $SF_6$ and 30% air;
$R_w$ rigid=43 dB;
$R_w$ flexible=46 dB;
Flexible connected with 4 mm thick pane.

EXAMPLE 2

$D_1$=10 mm;
DZ=30 mm, filld with a gas consisting of 70% $SF_6$+30% air;
$D_2$=4 mm;
$R_w$ rigid=42 dB;
$R_w$ flexible=46 dB;
Flexible connected with 4 mm thick pane.

EXAMPLE 3

$D_1$=15 mm;
DZ=50 mm, filled with air;
$D_2$=8 mm;
$R_w$ rigid=42 dB;
$R_w$ flexible=47 dB;
Flexible connected with 8 mm thick pane.

EXAMPLE 4

$D_1$=19 mm;
DZ=12 mm, filled with a gas consisting of 70% $SF_6$+30% air;
$D_2$=8 mm;
$R_w$ rigid=41 dB;
$R_w$ flexible=47 dB;
Flexible connected with 8 mm thick pane.

EXAMPLE 5

$D_1$=15 mm;
DZ=12 mm, filled with helium;
$D_2$=8 mm;
$R_w$ rigid=42 dB;
$R_w$ flexible=48 dB
Flexible connected to 8 mm thick pane.

These measurements were taken in an insulating window unit of 6 $m^2$.

EXAMPLE 6

$D_1$=10 mm;
DZ=50 mm, filled with a gas consisting of 40% $SF_6$+60% air;
$D_2$=4 mm;
$R_w$ rigid=45 dB;
$R_w$ flexible=50 dB;
Flexible connected to 4 mm thick pane.

EXAMPLE 7

Pane construction and gas filling same as in Example 6 except that free width of the steel membrane was divided in half to 6.5 mm.

$R_w$ flexible=50 dB.

EXAMPLE 8

Construction and gas filling as in Example 7 except that the thickness of the rubber lip is 5 mm and the Shore hardness is 40, as shown in FIG. 3;

$R_w$ flexible=51 dB.

EXAMPLE 9

Pane construction and gas filling as in Example 6 except that instead of a steel membrane of 0.15 mm thickness an aluminum strip of 0.1 mm thickness is used;

$R_w$ flexible=50 dB.

EXAMPLE 10

Geometry and gas filling as in Example 6 with the exception that the flexible steel membrane is replaced by a rubber membrane of 5 mm with a Shore hardness of 40.

EXAMPLE 11

$D_1$=19 mm;
DZ=50 mm, filled with a gas consisting of 70% $SF_6$+30% air;
$D_2$=8 mm;
$R_w$ rigid=44 dB;
$R_w$ flexible=54 dB;
Flexible connected to the 8 mm pane.

The relationship between the speed of sound in gas fillings which can be used in accordance with the present invention to the speed of sound in air and the ratio of the bending resistance can be found from Tables 1 and 2, respectively.

TABLE 1

| Gas | C (m/sec) | $\frac{C_G}{C_L}$ |
|---|---|---|
| 100% air | 329 | |
| 40% $SF_6$ + 60% air | 197 | 0.60 |
| 70% $SF_6$ + 30% air | 156 | 0.47 |
| 100% He | 966 | 2.94 |

TABLE 2

| Membrane | Glass | V |
|---|---|---|
| 0.15 mm steel | 4 mm | $1.6 \cdot 10^{-4}$ |
| | 8 mm | $2.0 \cdot 10^{-5}$ |
| 0.1 mm Al | 4 mm | $1.6 \cdot 10^{-5}$ |
| 5 mm rubber | 4 mm | $\sim 10^{-5}$ |

We claim:

1. An insulating window unit with improved acoustic damping, comprising:
an inner glass pane;
an outer glass pane;
a spacer frame connected to said panes around the peripheries thereof and spacing said panes apart to define a gas-filled compartment between the panes; and
at least one membrane strip bonded to a face of one of said panes along an edge zone thereof and connected to said frame, said membrane strip being of a material and dimensioned to follow deformation of said edge zone without significant resistance thereto, said strip having a flexural stiffness substantially less than that of said one of said panes at least in the region of said edge zone, the bending resistance of said in said zone being by a factor of $10^{-2}$ to $10^{-6}$ less than that of said one of said panes whereby transverse oscillations of said one of said panes correspondingly deform said strip.

2. The unit defined in claim 1 wherein said frame is received in a support block arrangement, said support block arrangement being spaced from the edge of said one of said panes by a distance greater than the wavelength of transverse oscillations in said edge zone at a track matching frequency of said unit.

3. The unit defined in claim 1, further comprising a body of acoustic damping material around the edge of said unit and contacting said strip or said edge.

4. The unit defined in claim 1 wherein said strip is composed of a material selected from the group which consists of metal, rubber and plastic.

5. The unit defined in claim 1 wherein said strip is planar.

6. The unit defined in claim 1 wherein said strip has a free width substantially equal to the thickness of said one of said panes.

7. The unit defined in claim 1 wherein said strip is bonded to one side of said one of said panes, said unit further comprising a cover lip resting against the opposite side of one of said panes and secured to said frame.

8. The unit defined in claim 1 wherein said panes have a total glass thickness of more than 10 mm, the spacing between said panes is 10 to 70 mm and the gas in said space is other than air.

9. The unit defined in claim 8 wherein the gas in said space has a speed of sound at least 10% less than that of air.

10. The unit defined in claim 8 wherein said gas in said space has a speed of sound at least 20% greater than that of air.

* * * * *